US009101211B2

(12) United States Patent
Cabal Velarde et al.

(10) Patent No.: US 9,101,211 B2
(45) Date of Patent: Aug. 11, 2015

(54) LEVELING SYSTEM

(75) Inventors: Victor Gerardo Cabal Velarde, Queretaro (MX); Alan Federico Camacho Velazquez, Tlalnepantla de Baz (MX); Ignacio Marin Ahumada, Queretaro (MX); Carlos Espinosa de los Monteros Fernéndez, Naucalpan (MX)

(73) Assignee: MABE, S.A. DE C.V., Queretaro (MX)

( * ) Notice: Subject to any disclaimer, the term of this patent is extended or adjusted under 35 U.S.C. 154(b) by 1217 days.

(21) Appl. No.: 12/463,567

(22) Filed: May 11, 2009

(65) Prior Publication Data

US 2009/0289537 A1 Nov. 26, 2009

(30) Foreign Application Priority Data

May 22, 2008 (MX) ..... MX/A/2008/006644

(51) Int. Cl.

| | |
|---|---|
| ***A47B 88/00*** | (2006.01) |
| ***F25D 25/02*** | (2006.01) |
| ***A47B 96/04*** | (2006.01) |

(52) U.S. Cl.

CPC ..... *A47B 88/0055* (2013.01); *F25D 25/024* (2013.01); *F25D 25/025* (2013.01); *A47B 2210/17* (2013.01)

(58) Field of Classification Search

CPC A47B 88/055; A47B 2210/17; F25D 25/025; F25D 25/024

USPC ..... 312/334.4, 334.5, 265.1–265.4, 223.1, 312/334.7, 334.8, 402, 404, 348.4, 348.1, 312/348.2; 384/22; 211/26; 248/298.1, 257, 248/258, 265, 269; 403/263; 292/256.67

See application file for complete search history.

(56) References Cited

U.S. PATENT DOCUMENTS

| | | | | | |
|---|---|---|---|---|---|
| 353,640 | A | * | 11/1886 | Nourse | 312/334.5 |
| 1,885,407 | A | * | 11/1932 | Boye | 211/96 |
| 2,013,500 | A | * | 9/1935 | O'Connor | 248/269 |
| 2,494,221 | A | * | 1/1950 | Wojakowski | 312/334.5 |
| 2,523,821 | A | * | 9/1950 | Fox | 312/334.4 |
| 2,551,843 | A | | 5/1951 | Knuth | |
| 2,620,248 | A | * | 12/1952 | Mutchnik | 403/263 |
| 2,698,214 | A | | 12/1954 | Skamser | |
| 3,730,469 | A | * | 5/1973 | Shields | 248/265 |
| 3,750,993 | A | * | 8/1973 | Read | 248/298.1 |

(Continued)

FOREIGN PATENT DOCUMENTS

| | | |
|---|---|---|
| AT | 390175 | 3/1990 |
| BR | 9604189 | 5/1998 |

(Continued)

*Primary Examiner* — Daniel J Troy
*Assistant Examiner* — Andrew Roersma
(74) *Attorney, Agent, or Firm* — Terry M. Sanks, Esq.; Beusse Wolter Sanks & Maire, P.A.

(57) ABSTRACT

A leveling system for panels or drawers within a cabinet comprising a rail; a front section having an intermediate opening, at least one opening and at least a first adjustment mechanism; wherein said rail supports said front section, and wherein said front section, supports at the same time, an inner wall by means of fastening means housed in said front section opening; a second adjustment mechanism disposed over said inner body housed in said front section intermediate opening; an adjusting means; and wherein said first adjustment means and said second adjustment means are linked by means of the adjusting means.

8 Claims, 8 Drawing Sheets

(56) References Cited

U.S. PATENT DOCUMENTS

| | | | | | |
|---|---|---|---|---|---|
| 4,141,525 | A | * | 2/1979 | Miller | 248/251 |
| 4,278,308 | A | | 7/1981 | Gotberg | |
| 4,278,309 | A | * | 7/1981 | Dreiling | 384/22 |
| 4,589,710 | A | * | 5/1986 | Rock et al. | 312/265.1 |
| 4,595,245 | A | * | 6/1986 | Rock et al. | 312/265.1 |
| 4,781,348 | A | * | 11/1988 | Cutforth et al. | 248/218.4 |
| 4,842,422 | A | | 6/1989 | Nelson | |
| 5,002,346 | A | * | 3/1991 | Gasser | 312/348.4 |
| 5,211,461 | A | * | 5/1993 | Teufel et al. | 312/334.4 |
| 5,310,255 | A | * | 5/1994 | Ranallo | 312/334.5 |
| 5,366,284 | A | | 11/1994 | Baker et al. | |
| 5,460,443 | A | * | 10/1995 | Ferrari et al. | 312/348.4 |
| 5,692,817 | A | | 12/1997 | Jun | |
| 5,758,512 | A | | 6/1998 | Peterson et al. | |
| 5,842,759 | A | * | 12/1998 | Ferrari et al. | 312/334.5 |
| 5,893,620 | A | | 4/1999 | Birgelis | |
| 5,971,190 | A | * | 10/1999 | Mannino | 220/320 |
| 5,980,009 | A | | 11/1999 | Atalla et al. | |
| 6,123,402 | A | | 9/2000 | Bowyer et al. | |
| 6,209,979 | B1 | | 4/2001 | Fall et al. | |
| 6,390,576 | B1 | * | 5/2002 | Walburn | 312/348.4 |
| 6,447,083 | B1 | * | 9/2002 | Chiapetta et al. | 312/404 |
| 6,449,976 | B1 | | 9/2002 | Chai et al. | |
| 6,565,170 | B2 | | 5/2003 | Banicevic | |
| 6,585,336 | B2 | | 7/2003 | Munday et al. | |
| 6,609,774 | B2 | | 8/2003 | Banicevic | |
| 6,641,239 | B2 | | 11/2003 | Kaiser | |
| 6,779,859 | B2 | | 8/2004 | Koons | |
| 6,874,739 | B1 | | 4/2005 | Gregory | |
| 6,902,244 | B1 | * | 6/2005 | Chen | 312/334.4 |
| 6,923,518 | B2 | | 8/2005 | Kim | |
| 6,945,618 | B2 | | 9/2005 | Kim | |
| 6,961,988 | B2 | * | 11/2005 | Koons | 29/525.11 |
| 6,971,730 | B2 | | 12/2005 | Koons | |
| 7,226,139 | B2 | | 6/2007 | Salice | |
| 2002/0043914 | A1 | * | 4/2002 | Munday et al. | 312/334.7 |
| 2003/0111943 | A1 | * | 6/2003 | Banicevic et al. | 312/404 |
| 2003/0160552 | A1 | * | 8/2003 | Bacho et al. | 312/334.5 |
| 2005/0264146 | A1 | * | 12/2005 | Fitz | 312/334.5 |
| 2006/0049731 | A1 | | 3/2006 | Choi et al. | |
| 2006/0244351 | A1 | | 11/2006 | Moon | |
| 2007/0252494 | A1 | * | 11/2007 | Freedenberg | 312/334.4 |

FOREIGN PATENT DOCUMENTS

| | | | | | |
|---|---|---|---|---|---|
| BR | 7900564 | | | 10/2000 | |
| BR | 0200137 | | | 10/2003 | |
| DE | 2432329 | | | 12/1975 | |
| EP | 0718574 | | | 6/1996 | |
| EP | 1440631 | A1 | * | 7/2004 | A47B 88/04 |
| EP | 1903288 | A2 | * | 3/2008 | F25D 23/02 |
| JP | 8240378 | | | 9/1996 | |
| JP | 2002360359 | A | * | 12/2002 | A47B 88/00 |
| JP | 2005241209 | | | 9/2005 | |

* cited by examiner

LEVELING SYSTEM

RELATED APPLICATIONS

This application claims priority from Mexican application Serial No. MX/a/2008/006644 filed May 22, 2008, which is incorporated herein by reference in its entirety.

FIELD OF THE INVENTION

The present invention refers to a drawer adjustment system and method, and particularly, to an adjustment and alignment system and method for the front panels or drawer doors using threaded adjustment means.

DESCRIPTION OF THE PRIOR ART

There are several different types of mounting implements to close the front access of bottom mount drawers, possibly in home appliances. In one embodiment, the drawer doors are mounted by hinges to the compartment lateral wall or liner, to allow door rotation in a vertical axis to open. In another embodiment, the door falls or rotates in a horizontal axis.

In yet another embodiment for mounting the bottom mount drawer, a drawer door slides horizontally relative to other compartments. In this embodiment, a door panel is secured to extending rails, usually telescopic, from the compartment that allow a front door panel to be pulled and pushed in a vertical axis relative to the compartment, to carry out the opening and closing of the compartment. Typically, this pullable door has a drawer or container in which articles are supported and are accessible to the user when the door is pulled towards the front part of the compartment.

A problem typically found with a pulling door in a compartment, is that the door is mounted directly in the telescopic arms of the guide rails, and thus, the positioning and securing of the guide rails within the compartment, is critical for the correct alignment of the front door panel, to close the aperture of the compartment front access and so that when carrying out the closing of said compartment, said closure aligns with the rest of the compartment. In some cases, providing guide rails is not within the tolerances, and thus, as a result, the door will be slightly inclined in relation to the compartment, resulting in an unpleasant appearance of the apparatus.

There have been several manners in which this problem has been solved. For example, U.S. Pat. No. 2,698,214 discloses a complete drawer adjustment manner, so that the sealing, once closed, is correct. U.S. Pat. No. 2,551,843 discloses drawer alignment means. U.S. Pat. No. 4,278,308 discloses a support adapted to be moved in a vertical and/or horizontal directional plain, wherein a drawer and a drawer guide system, may be aligned to prevent the bond between the drawer and its support structure.

U.S. Pat. No. 4,842,422 discloses a mechanism used to adjust the guide level, which at its time, adjust the rail level of an elongated drawer, relative to the cabinet support structure. U.S. Pat. No. 4,961,614 discloses a drawer including in each one of its ends an adjustment device proximal to the front plate for vertically and laterally adjusting the drawer with regards to the telescopic rails. U.S. Pat. No. 5,460,443 discloses a device for fastening and adjusting a drawer front panel with regards to its lateral panel, that comprises a sliding element, which slides by combining means in the longitude direction of the lateral panel. U.S. Pat. No. 6,447,083 discloses an isolated freezer compartment with telescopically extending rails, wherein one end of the rails has a front part, said front part is directed towards the drawer door, and has a pair of brackets to mount said door to the guide rails, in such a way that it allows the door to be adjusted to the compartment in regards to the horizontal and vertical axis. U.S. Pat. No. 6,585,336 discloses a sliding drawer with an adjustment device that includes a cam. The cam can be actuated to adjust the position of the drawer slide with respect to a drawer to which the drawer slide is attached. U.S. Pat. No. 6,874,739 discloses a positioning system that includes a first and second lift, and a leveling system. Each lift includes a base, an adjustment element including a tubular body having a first end coupled to the base and a second end, and a drive screw carried within the body and having an end extending from the body through the drive nut, the drive screw movable between a retracted position and an extended position by rotation of the drive nut, and a support plate coupled to the end of the drive screw.

U.S. Pat. No. 6,902,244 discloses the guide structure that includes two guide rails mounted to another pair of guide rails, and these to a rail mounted in the drawer. An adjustment screw is provided in the outer end of each one of the plates; a spring plate is located below the adjustment screw to make pressure. When the adjustment screw is threaded, the spring plate may be adjusted to a different level, and thus, the front panel of the drawer, may be adjusted in a different vertical position.

U.S. Pat. No. 6,923,518 discloses a rail and a mechanism to adjust rails. U.S. Pat. No. 6,945,618 discloses a rail position mechanism comprising a directional adjustment of the drawer with regards to the rail. U.S. Pat. No. 7,226,139 discloses a drawer height adjustment device, which, by means of a telescopic guide it hooks to a drawer side, which is guided by means of telescopic rails in support rails. U.S. patent application Ser. No. 11/406,238 with publication No. 2006/0244351 discloses a refrigerator having a height-adjustable door. The body of the refrigerator has at least one storage space having a front opening. By means of the use of a height adjustment screw that is coupled to the frame hinge, to travel vertically. The adjusting screw upper end abuts the bottom surface of the hinge bush so that, when rotated, the height adjustment screw lifts/lowers the hinge bush, in order to adjust the height of the door.

Austrian Patent No. 390175 discloses a drawer front panel adjustment element, wherein the front panel is directly adjusted with an adjustable inclination angle, the angles may be fixed by positioning screws in the front ends of the frame rails. German Patent No. 2432329 discloses a front drawer with alignment means.

Therefore, drawer or door front panel vertical alignment means are known in the art, however, there is a need for adjustment or alignment means in a vertical axis for drawer or door front panels, which are easy to produce, easy to adjust, ease to hide from the final user and easy that, in the case of being necessary, the end user may adjust the door, wherein said adjustment may be done manually by the user.

BRIEF DESCRIPTION OF THE INVENTION

The present invention contemplates a height adjustment system for a drawer front panel or a door front panel with regards to the rest of the drawer or door. The adjustment system of the present invention, is specially contemplated for drawer doors, that is, doors that slide in a horizontal axis along with a drawer. In an exemplary and non limitative manner, the invention may be used in two compartment refrigerator doors, wherein one compartment in the lower part, opens and closes in a slidable manner, an oven or dish washing machine wherein the door of said oven or dish washing machines be slidable in a horizontal axis, instead of the traditional rotatable opening in the lower axis if the door. Likewise, the adjusting system of the present invention, is adapted to any type of drawer, be it a typical cabinet of a home, a tool furniture cabinet or a drawer as those disclosed above. The adjusting system is preferably used in drawers whose weight is substantial, however, it is not limited to these types of drawers only.

The vertical adjusting system is used in drawers with rails. Specifically a first part of the adjustment mechanism is found in the front end of the rails, wherein said front end abuts with the door inner panel or inner liner, wherein said front end is capable of supporting the door by means of a bracket, support or similar mechanism, integrated in the front end of the rail.

The rail bracket functions to fasten the door or drawer front panel, wherein the rail bracket is capable of supporting the weight of said front panel and of said door. The weight of the front panel and door, is distributed by the rails, which are fastened to the wall or liner of the drawer or compartment, and thus, the door or drawer front panel weight is in fact supported by the wall or liner of the drawer or compartment.

The first part of the adjustment mechanism is a perpendicular part to the rail bracket, being said first part an integral piece with the rail bracket. Therefore, the first end of the adjustment mechanism, is a bracket in relation to the rail bracket.

A second front panel, totally independent of the rail, that is fastened to the door inner wall or inner liner, is aligned in the same vertical axis in a lower position than the adjustment mechanism first part, forming the adjustment mechanism second part. Both the first and second adjustment mechanism has at least one opening, in which a threaded member is added, where it preferably enters in a threaded manner, each member and opening having approximately the same dimension.

An adjusting means, which may be, however is not limited to, a screw, is capable of being threaded by the opening of both the first adjustment mechanism and the opening of the second adjustment mechanism.

As stated before, both the rail bracket and thus the first adjustment mechanism, and the second bracket or second adjustment mechanism, are fasted to the front wall or liner, which at its time is fasted to the drawer or compartment.

Therefore, when threading the adjustment means, said adjustment means will initially cross the first adjustment mechanism. When reaching the second adjustment mechanism, that is, when the adjusting means start to cross through the second adjustment mechanism, the adjusting means, by means of the work done in said adjusting means, starts to generate a normal force between the first adjustment mechanism and the second adjustment mechanism. The greater threading of the adjusting means with regards to the second adjustment mechanism, the greater normal force there will exist between the first adjustment mechanism and the second adjustment mechanism. Likewise, a partial tension force between the adjusting means, specifically the part which is in between the first adjustment mechanism and the second adjustment mechanism, exists.

When doing work in the adjusting means, and as a consequence, a normal force between the adjustment mechanisms and a partial tension force in the adjusting means, the adjusting means when crossing through the second adjustment mechanism, that is, when threaded towards the second adjustment mechanism, is capable of pulling down in a vertical axis the front panel or drawer or compartment door. When withdrawing the second adjustment mechanism adjusting means, that is, when unthreading the second adjustment mechanism adjusting means, the adjusting means is capable of pulling upwards in a vertical axis the front panel or drawer or compartment door.

Likewise, a simple adjusting means if the front panel or drawer or compartment door is created, that allows adjusting in both sides of the front panel or compartment in an independent manner, wherein both the producer as the final user may have easy access to the system to adjust the front panel or compartment, and wherein the system is not directly visible by the end user.

Therefore, it is an object of the present invention creating a simple system to adjust a drawer front panel. A further object, is providing a drawer front panel adjustment mechanism and system, that may be adjusted by both the producer and the end user.

It is a further object of the present invention, allowing the system, by means of force and work, to be capable of vertically pulling up and down the drawer front panel.

Another object is providing a home appliance with the present invention.

Finally, another object of the present invention is providing a method wherein a front panel or compartment or drawer door may be adjusted.

Other objects and advantages of the present invention will become clear when having reference of the specification taken into account with the following figures.

BRIEF DESCRIPTION OF THE FIGURES

The particular features and advantages of the invention, as well as other objects of the invention, will become clear of the following specification, taken in connection with the accompanying figures, which.

DETAILED DESCRIPTION OF THE INVENTION

The present invention is not limited to be used in refrigerators, rather, it may be used in other home appliances, such as ovens, washing machines, dish washing machines, conventional drawers and any other type of cabinet, as well as any type of drawer.

Figure 1:
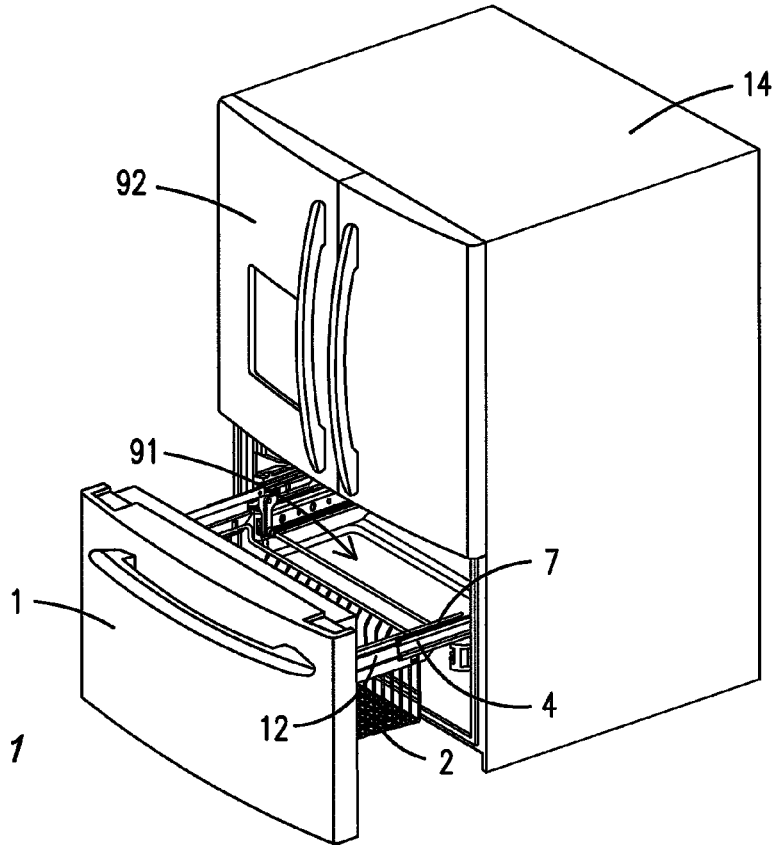
FIG. 1 is an upper conventional perspective view of a refrigerator.

FIG. 1 in an exemplary manner, illustrates a refrigerator, wherein the use of two compartment may be seen, an upper compartment (92) and a lower compartment or drawer (91). Usually, the upper compartment (92) is a fresh food compartment with greater temperatures, while the lower compartment (91) has lower temperatures, which is the base of study of our invention. In said lower compartment (91), which has, among its components, a basket (2), a door (1), which are sustained by a support (7), which at its time has as its own components a mobile vehicle (12), as well as a rail (4), which are sustained to the lower compartment (91) inner wall (93), said rails (4) and mobile vehicle (12), in the great majority of the cases, form a telescopic system, which may slide in its horizontal axis, opening and closing the lower compartment (91). The basket (2) is capable of sustaining or storing articles.

Figure 2:
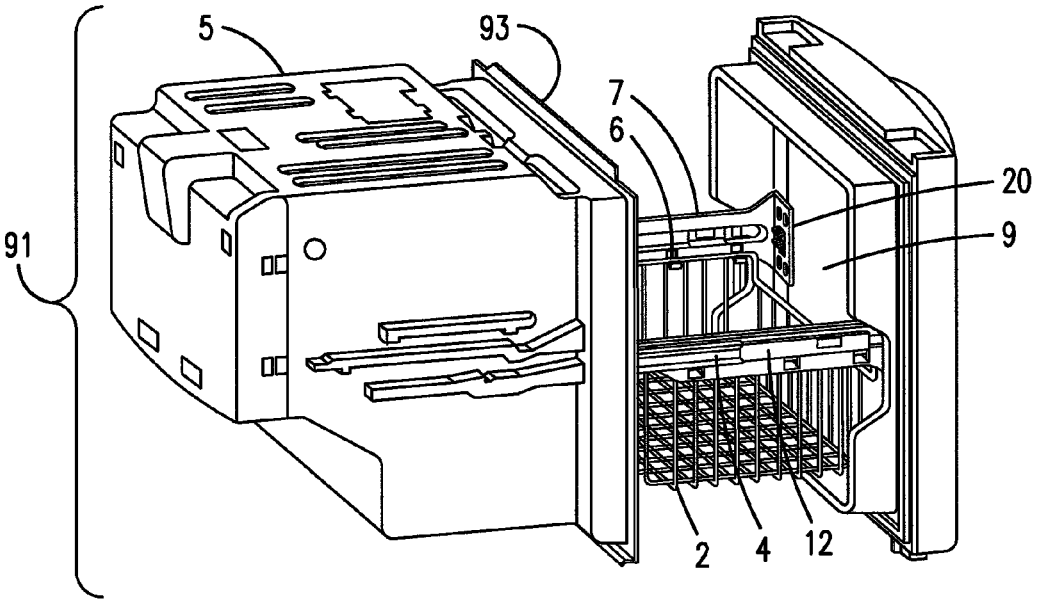
FIG. 2 is a back conventional perspective view of a compartment using the adjustment system of the present invention.

In a lower compartment (91) having as a member a drawer (5), as shown in FIG. 2, in said drawer (5), the rail (4) is fasted to the inner wall (93) of the mentioned drawer (5).

A rail (4) is commonly integrated by diverse components, wherein at least one of these components is called mobile vehicle (12) which is embedded within a second part, said mobile vehicle (12) slides with regards to the second part, which at the same time embeds or surrounds it, which is commonly fastened to the inner wall (93) or liner of the lower compartment (91) using fastening means (26). A support (7) which is fastened to the mobile vehicle (12), wherein said support (7) contains projections (6), which allow attaching the basket (2), which at its time will hold the articles within it. At the same time, the support (7) in its front part, has a front section (20), which holds the door (1) using fastening means (26) which are inserted in the door (1) inner wall (9). Throughout the support (7), in said support (7), at least two projections (6) may be usually found, being located along said support (7) in an equilibrated distance to provide stability to the basket (2).

Figure 3:
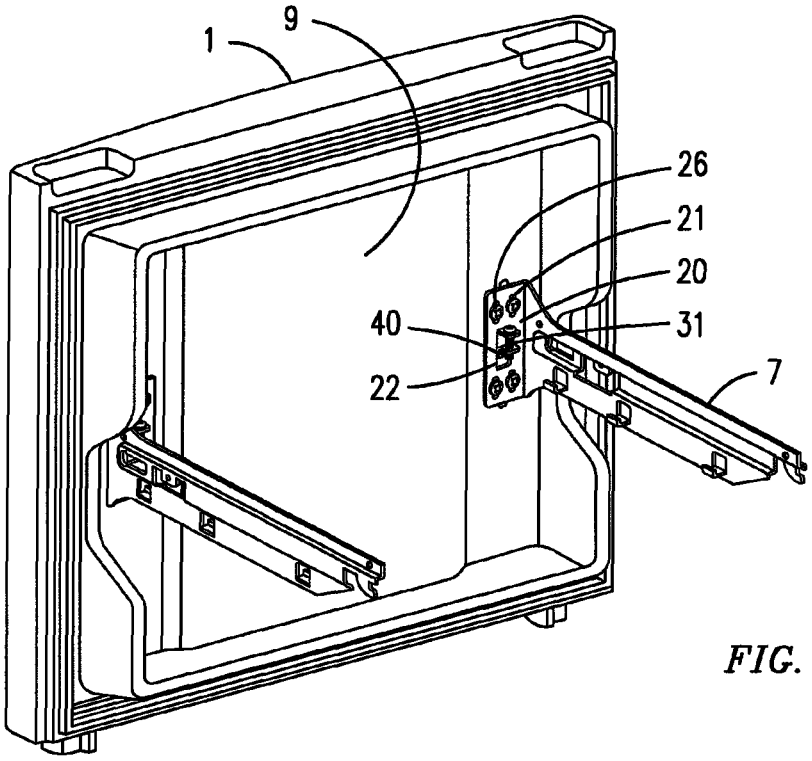
FIG. 3 is a right back conventional perspective view of the adjustment system of the present invention being used in a drawer front panel.
Figure 4:
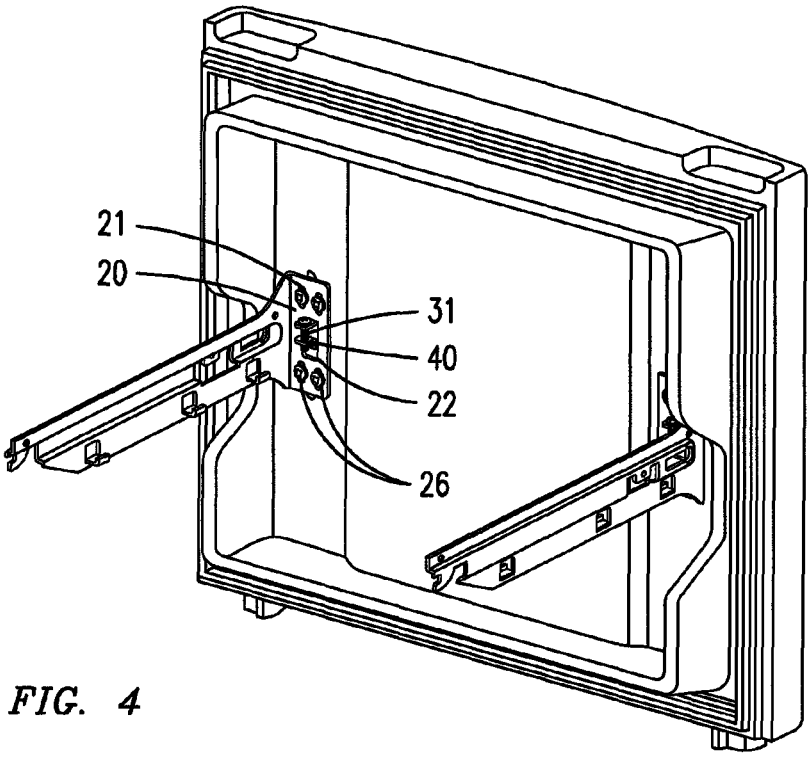
FIG. 4 is a left back conventional perspective view of the adjustment system of the present invention being used in a drawer front panel.

In the rail (4) mobile vehicle (12) front section (20), a front section (20) may be found, that is capable of fastening the inner wall (9) or inner liner (9), which at its time, holds the lower compartment (91) door (1), by means of openings (21) in the support (7) front section (20), wherein using fastening means (26) as well as openings (10) located in the inner wall (9) or inner liner (9), as may be seen in the right and left conventional perspective views of FIGS. 3 and 4 respectively.

FIGS. 3 and 4 are right and left views respectively, both in conventional perspective, of the support (7) for the rail (4) with a front section (20), as well as a first adjustment mechanism (23) and a second adjustment mechanism (40). In both sides of the door (1) inner wall (9), the same model of adjusting and alignment mechanism of the present invention is used. The front section (20), as well as the support (7), are the same segment or piece, or both can be separate, and in some moment are joined between themselves, providing the original functionality. The front section (20) is substantially perpendicular to the support (7).

The front section (20) is made up of at least one opening (21). The inner part of the opening (21), is preferably threaded, so that a fastening means (26) is introduced in it, which may also be threaded, this fastening means (26) may, and is not limitative to a screw, pin, fastener, or any other fastening means (26) that may be threaded or introduced in an opening (21), said fastening means (26) crosses through said opening (21). Likewise, the door (1) inner wall (9) or inner liner (9), has at least one opening (10), preferably the same number of openings (21) that the front section has (20), which at the same time, the inner wall (9) or inner liner (9) will have. The inner part of the inner wall (9) or inner liner (9) door opening (10), is preferably threaded by the same fastening means (26), which will be threaded, to likewise cross the inner wall (9) or inner liner (9) opening (10). Therefore, the front end (20) opening (21), along with the inner wall (9) or inner liner (9) opening, are co-lineal. At least one opening (21) in the front section (20) may be found, and more preferably, at least for openings (21) in the front section (20). As stated before, the same number of openings (21) found in the front section (20) should be found in the door (1) inner wall (9) or inner liner (9).

The front section (20) opening (21) has preferably an oval shape, wherein said oval has the same width that the diameter width of the fastening means (26) threaded part, and wherein the oval has a length greater than the width diameter of the fastening means (26) threaded part. That is, the oval shaped front section (20) opening (21), has a length greater than its width. However, the door (1) inner wall (9) or inner liner (9) opening (10) diameter, has to be substantially similar to the width diameter of the fastening means (26) threaded part. That is, the oval shaped front section (20) opening (21), has a length greater than its width. However, the opening (10) diameter in the door (1) inner wall (9) or inner liner (9), has to be substantially similar to the width diameter of the fastening means (26) threaded part.

In the front section (20) intermediate part, an intermediate aperture (22) is found. The intermediate aperture (22), faces the door (1) inner wall (9) or inner liner (9). The aperture (22) has substantially the same length than an adjusting means (31) as well as the same width than a second adjustment mechanism (40).

Figure 5:
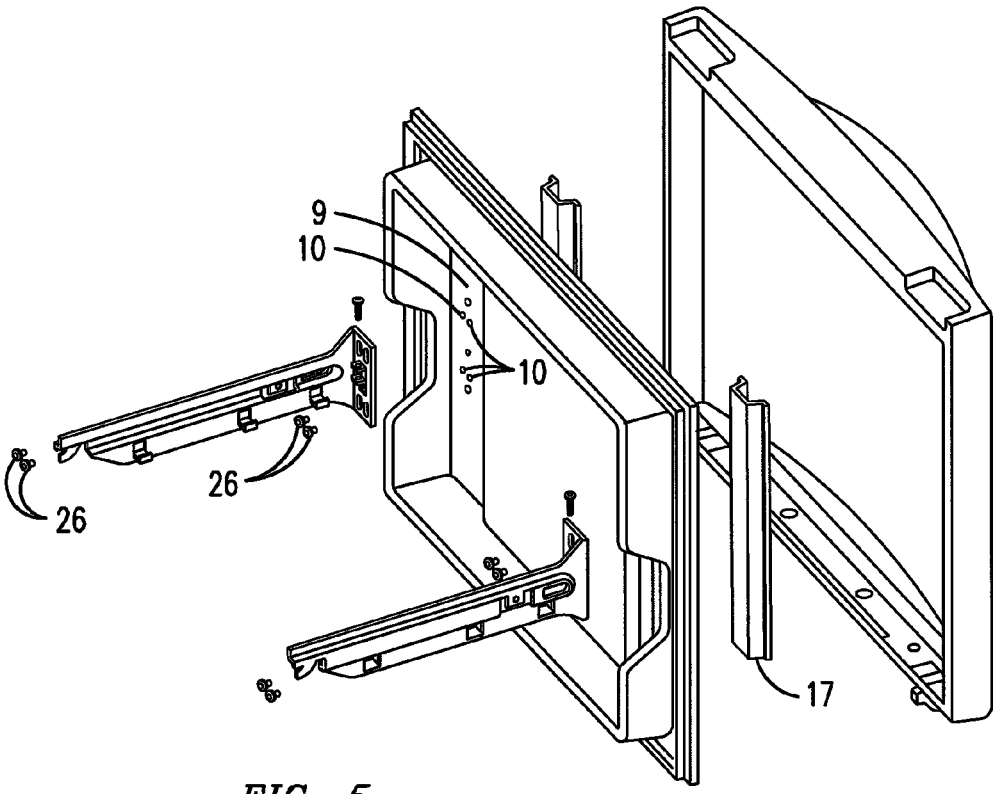
FIG. 5 is an exploded upper conventional perspective view of the adjustment system of the present invention, being used in a drawer front panel.

In the exploded conventional perspective view of FIG. 5, it may be seen how the fastening means (26) are profiled to penetrate, preferably, however not limited to, by threading, the front section (20) openings (21). In said FIG. 5, for fastening means (26) for each front section (20) may be appreciated, as well as four openings (21) for said front section (20), as well as four openings (10) in the door (1) inner wall (9) or inner liner (9). The quantity of openings (21, 10) exists in relation to the front section (20), as well as in regards to the door (1) inner wall, being of great importance due to the stability and security between both parts, and thus being of vital importance that the front section (20), as well as the door (1) inner wall (9), have the same number of openings (21, 10).

Figure 5A:
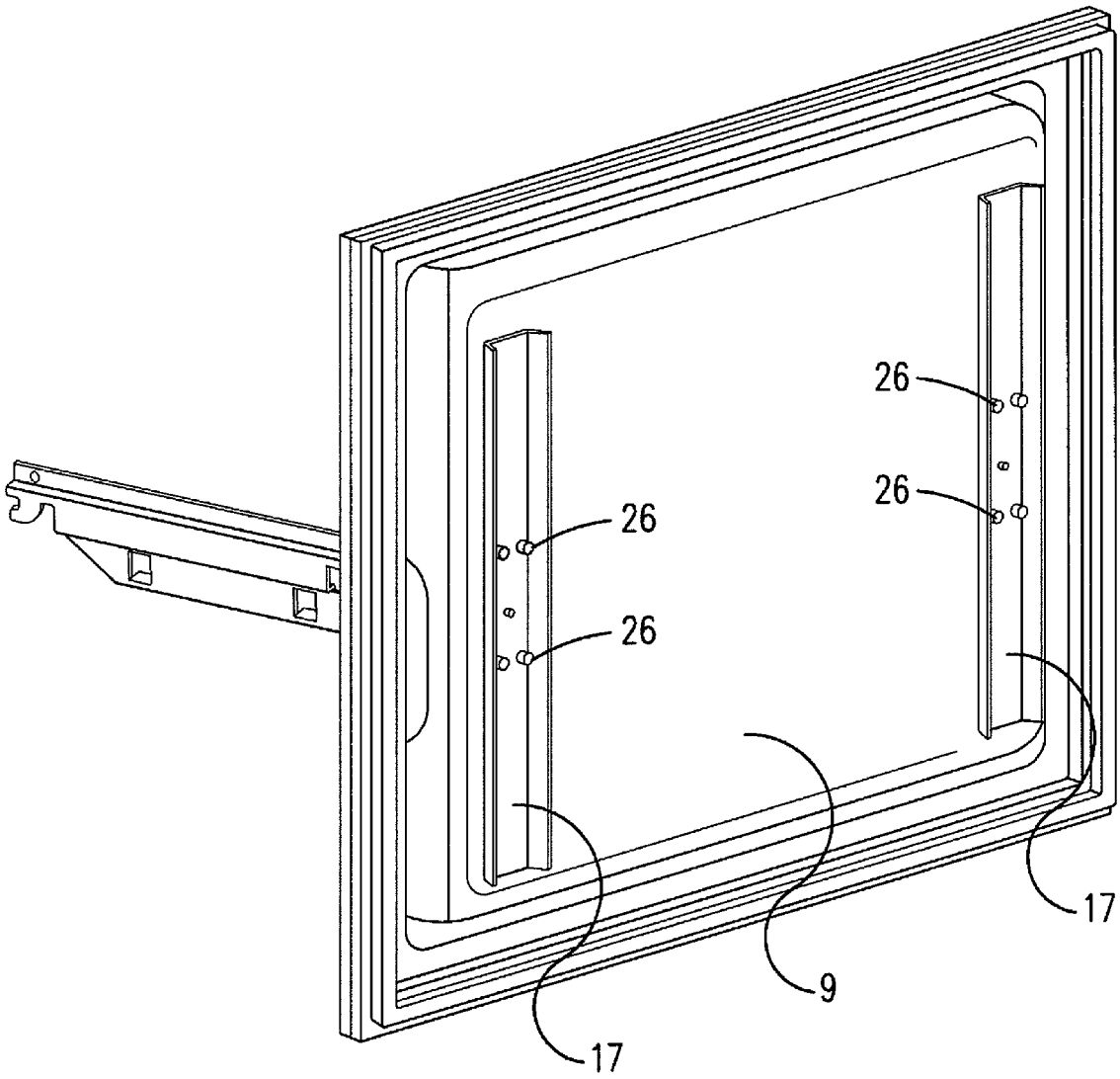
FIG. 5*a* is an exploded upper conventional perspective view of the adjustment system of the present invention, being used in a drawer front panel.

It should be noted that in the example of a refrigerator or isolated cabinet compartment (91) drawer (5), the door (1), through its inner wall (9) makes a "liner", said "liner" is based on a sheet, plate or plastic laminate, which is later subjected to a thermoforming process, having said inner wall or liner (9) a low thickness that will not allow it to burden the weight of the front panel or drawer (5), and thus, a pair of support beams (17) helpful for supporting, without depending on the resistance of the inner wall or liner (9), since the fastening means (26) are fastened or anchored in said support beams (17), as may be seen in FIGS. 5 and 5*a*. It is also noted that if the material, consistence or width of the inner wall (9) allows it, said support beams (17) are not necessary.

Figure 6:
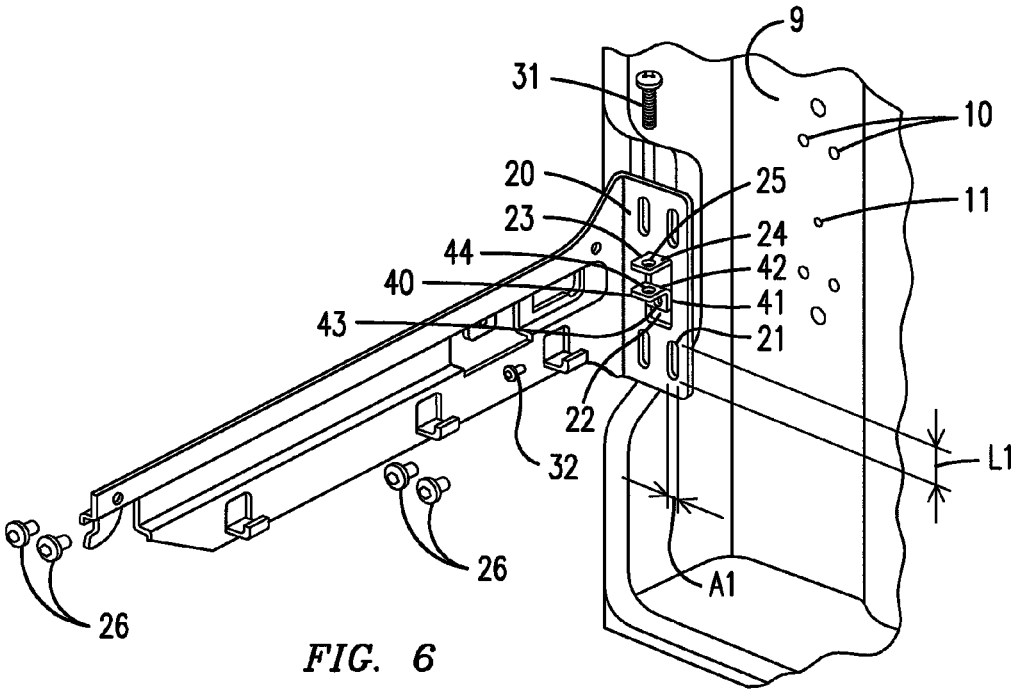
FIG. 6 is an exploded detailed conventional perspective view of the present invention.

FIG. 6 shows in a detailed manner the front section (20) opening (21), said opening (21) being oval shaped, said shape is not a limitation for the invention being studied. The afore mentioned is characterized for having a circular longitude ($L_1$) in a vertical axis, which is greater to the circular width ($A_1$) in a horizontal axis, i.e. $L1>A_1$, wherein the front section (20) openings (21) have the same dimension. The door (1) inner wall (9) or inner liner (9), wherein the openings (10) are circle shaped, however not limited to a circular shape, achieve the same length and width in comparison to the openings (21). The inner wall (9) or inner liner (9) openings (10) have substantially the same dimension than the width dimension of the fastening means (26) threading part.

A first adjustment mechanism (23) that is part of the front section (20), wherein said front section (20) first adjustment mechanism (23) which is perpendicular, is made up of an upper edge (24) of the intermediate section (22). The first adjustment mechanism (23) is part of the front section (20), wherein the first adjustment mechanism (23) is positioned perpendicular to the rest of the front section (20). The first adjustment mechanism (23) intermediate part, is made up of an opening (25), preferably threaded, wherein in said opening (25) a fastening means (26) is introduced. The intermediate opening (22) is centered taking in regards the relation kept by the vertical dimension, as well as the horizontal dimension of the front section (20). The intermediate section (22) is located in the central part of the front section (20), for better reference it is symmetrically placed between the upper openings (21) and the lower openings (21) as exemplified in FIG. 6.

A second adjustment mechanism (40), which is totally independent of the front section (20), is fastened to the inner wall (9) or inner liner (9) by means of the front section (20) intermediate opening (22). Said second adjustment mechanism (40) is made up of two perpendicular walls between themselves, wherein first wall (41) which abuts with the inner wall (9) or inner liner (9) has a first opening (43), a second wall (42) which is perpendicular to the first wall (41), consequently to the inner wall (9) or inner liner (9) has a second opening (44).

A second fastening means (32) fastens the second adjustment mechanism (40) with the internal wall (9) or inner liner (9), by means of threading, which does not limit the second fastening means (32), which could or could not be a threaded second fastening means (32), said fastening means (32) is crossed through the first wall (41) opening (43) and smaller opening (11) found in the door (1) inner wall (9) or inner liner (9). The width of the second fastening means (32) threading part is substantially similar to the door (1) inner wall (9) or inner liner (9) smaller opening (11) diameter, through which the second fastening means (32) crosses when using the chords in the same fastening means (32). The second adjustment mechanism (40) is fastened to the door (1) inner wall (9) or inner liner (9) in view of the fastening means (32). The width of the second adjustment mechanism (40) first wall (41) is slightly less than the width of the intermediate aperture (22) so that the second adjustment mechanism (40) is installed within the front section (20) intermediate aperture (22).

The first adjustment mechanism (23) opening (25) is aligned in the same vertical axis than the second adjustment mechanism (40) second wall (42) opening (44), using fastening means (32), as well as the adjusting means (31).

Since the front section (20) opening (21) longitude ($L_1$) is greater than the fastening means (26) width, and since the inner wall (9) or inner liner (9) openings (10) diameter are substantially similar to the fastening means (26) diameter width, movement in a vertical axis through longitude (L1) is allowed, for the inner wall (9) or inner liner (9), and consequently the door (1) with regards to the lower compartment (91), particularly in regards to the rail (4) and more particularly with regards to the rail (4) support (7).

Figure 7:
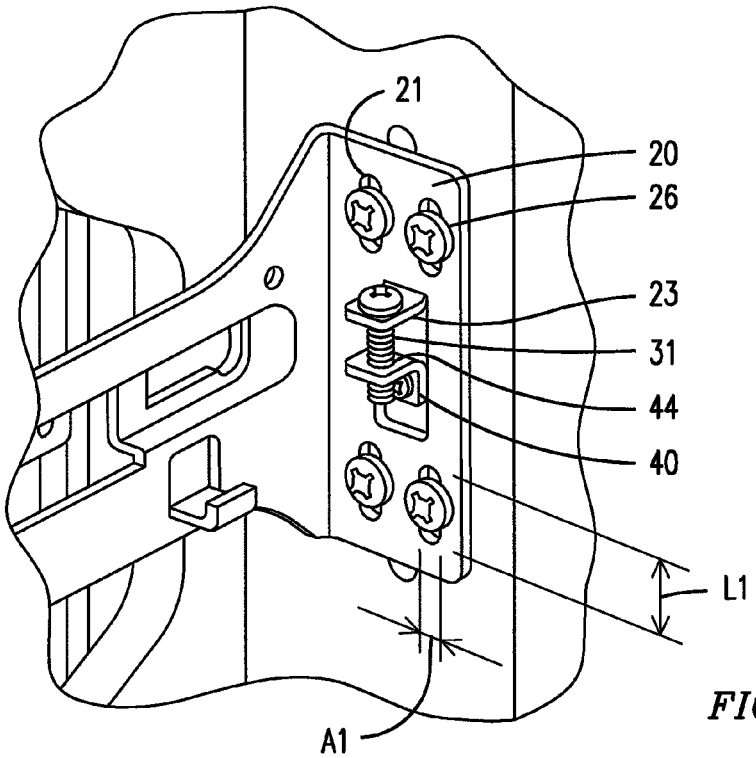
FIG. 7 is a detailed upper conventional perspective view of the present invention.

FIG. 7 is a detailed upper view of the adjustment and alignment system of the present invention. Specifically, FIG. 7 shows how the front section (20) openings (21) have a longitude (L1) greater than the fastening means (26) diameter width. Also, the front section (20) openings (21) have a width (A1) similar to the fastening means (26) diameter width. The difference between the front section (20) openings (21) longitude (L1), as well as the fastening means (26) diameter width, allows movement of the door (1) in a vertical axis.

The door (1) movement in a vertical axis, is controlled by the adjusting means (31), said adjusting means (31) crosses in its central part the opening (25) concerning the first adjustment mechanism (23), and further crosses in its central part the opening (44) concerning the second adjustment mechanism (40).

Figure 8:
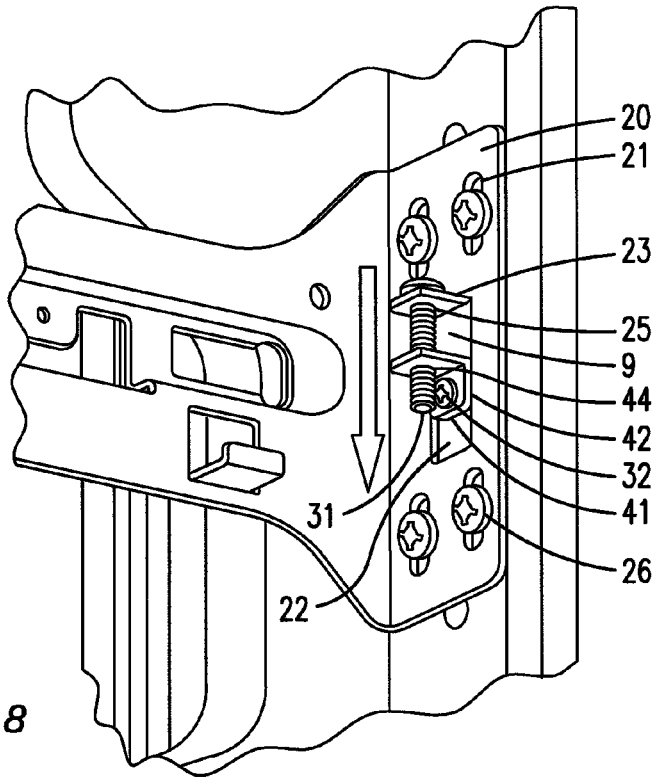
FIG. 8 is a detailed lower conventional perspective view of the present invention.

FIG. 8, characterized by a second adjustment mechanism (40) fastened to the inner wall (9) or inner liner (9) through the aperture (22), said second adjustment mechanism (40) is fastened by a second fastening means (32), which crosses though the second adjusting mechanism (40) first wall (41) central opening (43), which extends until reaching the door (1) inner wall (9) or inner liner (9) smaller opening (11).

The alignment of the second adjustment mechanism (40) in the inner wall (9) or inner liner (9) uses as a reference the intermediate aperture (22), the first adjustment mechanism (23) opening (25) and the second adjustment mechanism (40) second wall (42) opening (44), thus being aligned in the same vertical axis. The adjusting means (31) crosses in its central part the first adjustment mechanism (23) opening (25), as well as second adjustment mechanism (44) second wall (42) opening (44).

The adjusting means (31) initially crosses the first adjustment means (23) opening (25), until reaching the second adjusting means (40), and when initiating its crossing through the second adjusting means (40) opening (44), the adjusting means (31) generates work, in other words, the threading or un-threading done by the adjusting means (31), generates a normal force between the first adjustment mechanism (23) and the second adjustment mechanism (40), administering preciseness, firmness and immobility when aligning the door (1) with the lower compartment (91), as well as with the rail (4) along the support (7), achieving rigidity in the already aligned components.

The more incorporated or threaded the adjustment means (31) is with regards to the second adjustment mechanism (40), the greater normal force there will be between the first adjustment mechanism (23) towards the second adjustment mechanism (40), wherein the normal force created by the work of threading, translates in pulling up the inner wall (9) or inner liner (9), obtaining thus, the pulling up of the door (1). When making the insertion or threading work of the adjusting means (31), there exists as a consequence a normal force between the first adjusting mechanism (23) and the second adjusting mechanism (40), and thus creating a tension force in the adjusting means (31). This normal force is represented by the arrow in FIG. 8, which is the same direction as gravity, since the adjusting means (31) pushes the first adjustment mechanism (23) towards the second adjusting mechanism (40), obtaining drive from the inner wall (9), carrying with it the door (1) in the same direction. Said normal force, lowers the lower compartment (91) door (1), and said normal force lowers the drawer (5). The race in the vertical axis of the door (1) is allowed in view that the longitude ($L_1$) of the front section openings, are greater than the diameter width of the fastening means (26). Said race in the vertical axis of the door (1) is limited by longitude ($L_1$).

When withdrawing or unthreading the adjusting means (31) from the second adjustment mechanism (40), the adjusting means (31) of the second adjustment mechanism (40), said adjusting means (31) diminishes the normal drive force made by the adjusting means (31) in regards to the first adjusting mechanism (23), therefore, tension release of the second adjustment mechanism (40) is allowed, and consequently the inner wall (9) goes up in a vertical axis, and thus so does the drawer (5) door (1).

The race done by the drawer (5) door (1) is caused by the insertion or withdrawal, threading and unthreading of the adjusting means (31) through the first adjustment mechanism (23) opening (25), as well as through its crossing though the second adjusting mechanism (40) opening (44), said race is carried out by the passing of the fastening means (26) throughout longitude (L1) of the front section (20) opening (21). The insertion or withdrawal race, threading or unthreading of the adjusting means (31) through the first adjustment mechanism (23) opening (25), as well as through the second adjustment mechanism (40) opening (44), said race is limited by the passing of the fastening means (26) throughout longitude (L1) of the front section (20) openings (21).

Figure 9:
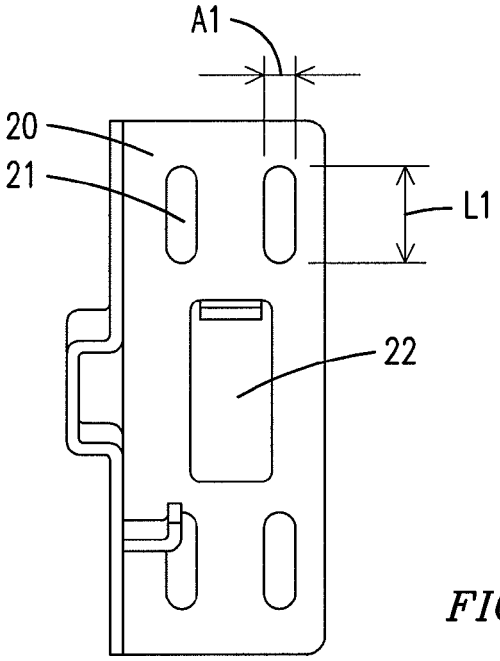
FIG. 9 is a front view of the present invention bracket.

FIG. 9 shows a front view of front section (20), wherein the race of the adjusting means (31) is shown, which is limited by longitude (L1) of the front section (20) openings (21), caused by the contact of the fastening means (26) with the upper or lower edges of the openings (21), further limiting the insertion or withdrawal, threading or unthreading the adjusting means (31). Longitude (L1) may be seen in FIG. 9. Likewise, the fact that width (A1) is essentially less than longitude (L1) may also be seen. Thus, width (A1) has a dimension essentially similar to the fastening means (26) diameter width, and therefore, when being less the width (A1) than length (L1), the fastening means (26) diameter width is less than longitude (L1).

The intermediate aperture (22), stated above, is placed in the central part, in reference to the front section (20) openings (21).

Figure 10:
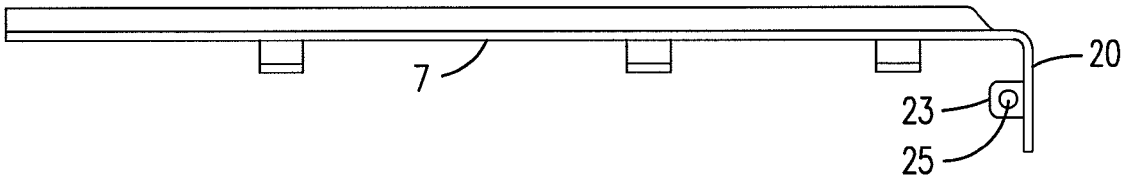
FIG. 10 is an upper view of the rail, with the present invention bracket.

FIG. 10 shows the front section (20), said front section (20) is a component formed from a single piece with the support (7) body, which does not limit the fact of having separate components or sections, to thus form the support (7) set, front section (20). The front section (20) may or may not form part of the support (7), said support (7) is sustained by the rail (4). The perpendicular relation between the first adjustment mechanism (23) with regards to the rest of the front section (20), is essentially important, since the front section (20) will sustain, by means of the first adjustment means (23), as well as by the second adjustment mechanism (40), using an adjusting means (31), the inner wall, which at its time, supports the door (1). The first adjustment mechanism (23) contains the opening (25) through which the adjusting means (31) will be crossed, and in its case, threaded, which will reach the second adjustment mechanism (40) opening (42), wherein both mechanism will provide the adjustment for the drawer (5) door (1).

Figure 11:
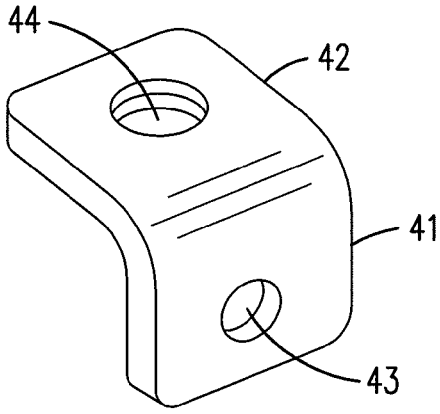
FIG. 11 is a convention perspective view of the present invention second adjustment mechanism.

The second adjustment mechanism (40) second wall (42) opening (44), is aligned in the same vertical axis with regards to the first adjusting mechanism (23) opening (25). FIG. 11 shows the second adjustment mechanism (40) second wall (42), wherein the second wall (42) has the same width than the first wall (41), since the first wall (41) will have a width lesser or similar to the width of the front section (20) intermediate opening (22). Since the adjusting means (31) has a similar or greater length than the front section (20) intermediate opening (22), wherein the distance between the first adjustment mechanism (23) with regards to the second adjustment mechanism (40) is limited, caused by the adjusting means (31), wherein said adjusting means (31) has a length similar to the length of the front section (20) intermediate aperture (22), wherein the second adjustment mechanism (40) is fastened to the inner wall (9) or inner liner (9), said second adjustment mechanism (40) will cross the front section (20) intermediate aperture (22).

FIG. 11 also shows the openings (44, 43) of the second adjustment mechanism (40), said openings (44, 43), preferably have in their inner part a chord, in which the adjusting means (31) will be introduced or threaded, as well as the rest of the openings (10, 11, 21, 25).

An assembly method for a door is also possible with the present system. In FIG. 6, front section (20) openings (21) are aligned with the inner wall (9) or inner liner (9) openings (10). Said openings (21, 10) are crossed using a fastening means (26). The second adjustment mechanism (40) is aligned within the front section (20) intermediate aperture (22), the second adjustment mechanism (40) first wall (41) opening (43), is also aligned with inner wall (9) or inner liner (9) smaller opening (11), holding the door (1). Said openings (43, 11) are crossed by a second fastening means (32), thus resulting in an alignment for the first adjustment mechanism (23) and the second adjustment mechanism (40) openings (25, 44), both mechanisms being aligned in the same vertical axis. The mount and alignment of the afore mentioned mechanisms, comprise crossing by means of inserting or threading an adjusting means (31), which crosses the first adjustment mechanism (23) and second adjustment mechanism (40) openings (25, 44), wherein an adjusting means (31) is introduced or withdrawn, when the threading or unthreading of said adjusting member (31) creates a race between the fastening means (26) throughout the front section (20) opening (21) creating a force capable of elevating, moving or lowering a limited longitude given by the support (7) front section (20) opening (21).

Figure 12:
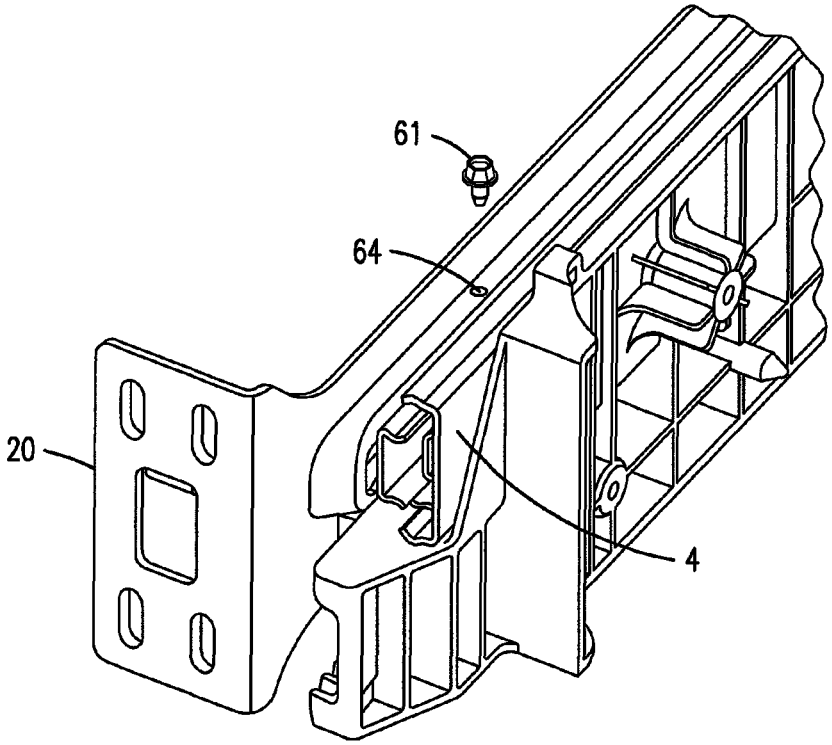
FIG. 12 is a conventional perspective view showing the third adjusting mechanism which operates in an embodiment of the present invention.
Figure 13:
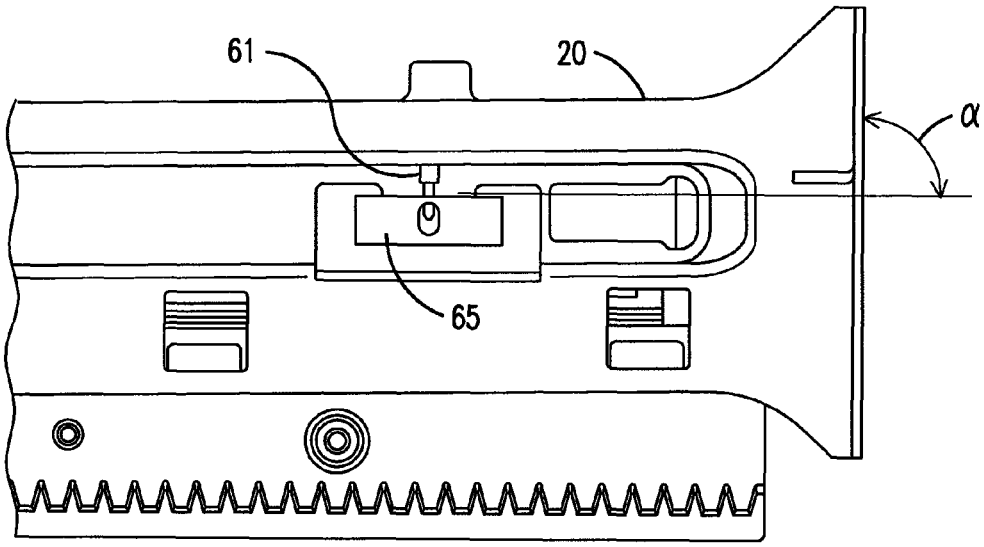
FIG. 13 is a lateral view showing the third adjusting mechanism, which operates in an embodiment of the present invention.
Figure 14:
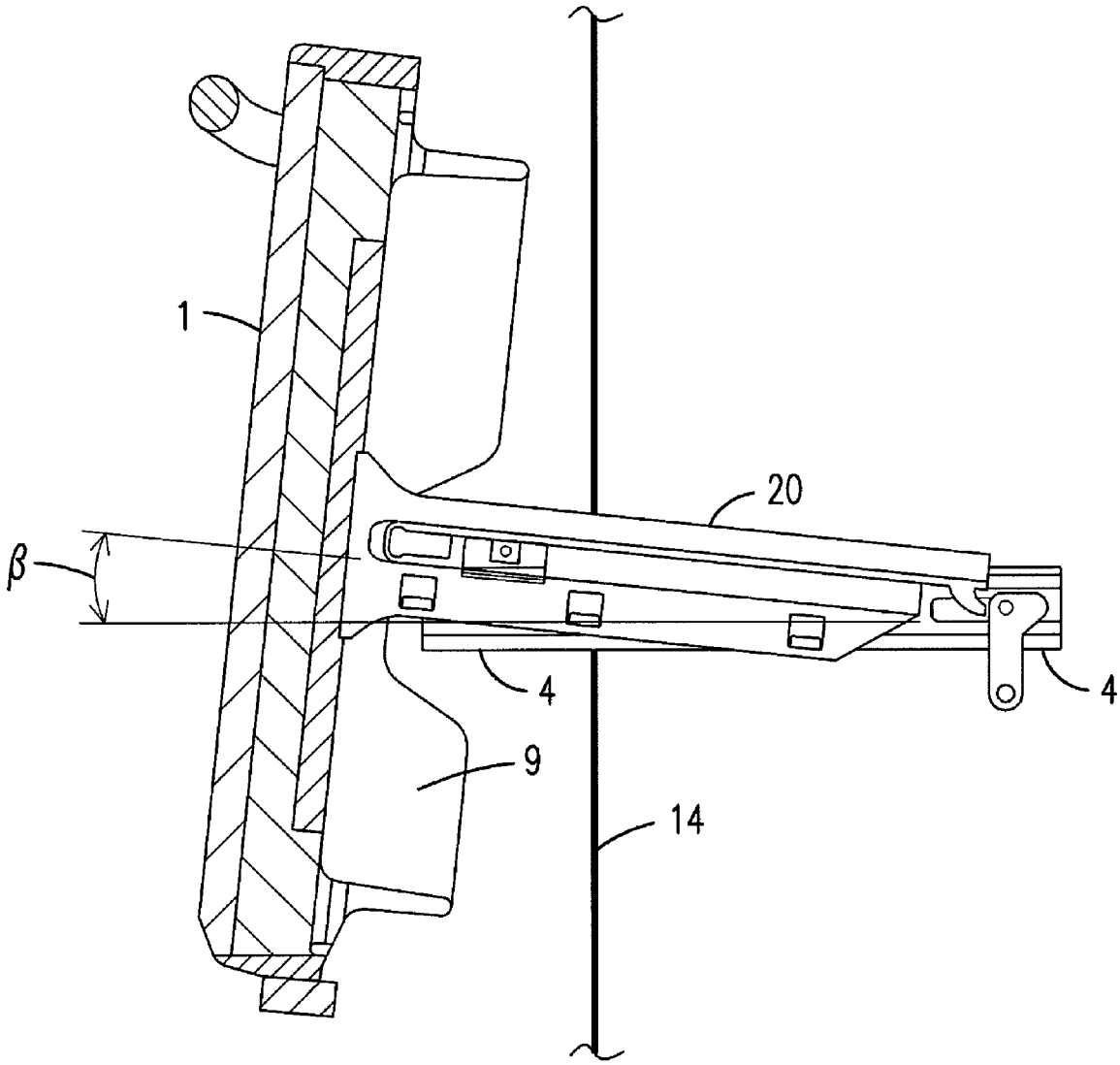
FIG. 14 is a schematic showing the coupling angle achieved with the third adjusting mechanism of the alternate embodiment of the present invention.

An alternate embodiment for the invention is illustrated in FIGS. 12, 13 and 14, given that FIG. 12 shows a third adjustment mechanism (61) that allows elevating the front section (20) front part with regards to the longitudinal line of the rail (4), in ideal conditions an $\alpha$ angle that comprised between the longitudinal line of the rail (4) and the vertical face of the front section (20) must be approximately between 75° and 110°, more preferably about 90°, however, due to the dimensional discrepancies of the manufacture process, said angle $\alpha$ may vary up until 25°, which causes the door (1) not to seal correctly with the front face of the cabinet (14); as illustrated in FIG. 14, the longitudinal line of the rail (4) and the longitudinal line of the front section (20) describe an angle $\beta$, which may be modified in view of the third adjusting mechanism (61); which in the front section (20) upper back has a threaded opening (64) through which the third mechanism (61) is crossed, which preferably may be a screw, the base or lower part of said third adjustment mechanism (61) abuts projection (65), which in a preferred embodiment is a section abutted with the rail (4) face, and therefore, the third adjustment mechanism (61) abuts its lower face over the upper edge of said projection (65), thus, when threading, unthreading or adjusting the third adjusting mechanism (61), angle $\beta$ is regulated, given that the back part of the front section (20) rests over the rail (4) back part, serving in this point, both parts as a kind of a hinge, or even this embodiment may be provided with a hinge mechanism between the commented parts. Therefore, when graduating or adjusting the third adjustment mechanism (61) so as to manipulate angle β, the parallelism between the door (1) or interior wall (9) and the front face of the cabinet (14) is adjusted.

Alterations to the structure disclosed in the present invention, may be seen by those skilled in the field. However, it should be understood that the present invention relates to the preferred embodiments of the invention, which is for illustrative purposes only, and should not be construed as a limitation of the invention. All amendments that do not depart from the spirit of the invention are included within the body of the attached claims.

The invention claimed is:

1. A leveling system for panels or drawers within a cabinet comprising:

a rail;

a front section having a first pair of lateral interior edges and a second pair of internal edges perpendicular to the lateral edges, the first and second pairs of interior edges defining an intermediate opening, which is centrally located relative to the front section, the front section further having at least one opening and at least a first adjustment mechanism;

wherein said rail supports said front section, and wherein said front section, supports at the same time, an inner wall of the panel or drawer by means of at least one fastening means housed in said front section opening, and said intermediate opening;

a second adjustment mechanism disposed directly over said inner wall housed in said front section intermediate opening, the second adjustment mechanism mechanically independent from the front section;

an adjusting means;

wherein said first adjustment mechanism and said second adjustment mechanism are linked by way of the adjusting means; and wherein the front section is adjustably positioned along a vertical axis relative to the inner wall, wherein the second adjustment mechanism comprises a pair of mutually perpendicular walls, one of said walls positioned in a vertical plane and having a width sufficient to be received between the pair of lateral interior edges of the intermediate opening and maintain alignment relative to said vertical axis as the front section, together with a mechanical load comprising the panel or drawer, is adjustably positioned along the vertical axis.

2. The system according to claim 1, wherein the second adjustment mechanism is fastened to said inner wall or an inner liner by way of at least a second fastening means.

3. The system according to claim 1, wherein the inner wall is between said front section and at least one support beam.

4. The system according to claim 1, wherein the at least one opening has a greater longitude than width.

5. A home appliance comprising the leveling system of claim 1.

6. The leveling system of claim 1, wherein the rail and said front section comprise a singular structure.

7. A leveling system for panels or drawers within a cabinet comprising:

a rail;

a front section a first pair of lateral interior edges and a second pair of internal edges perpendicular to the lateral edges, the first and second pairs of interior edges defining an intermediate opening, which is centrally located relative to the front section, the front section further having at least one opening and at least a first adjustment mechanism affixed to the front section;

wherein said rail and said front section form a singular structure, and wherein said front section supports an inner wall by way of at least one fastener housed in said at least one opening;

a second adjustment mechanism stationarily and directly affixed to said inner wall housed in said intermediate opening, wherein the second adjustment mechanism is mechanically independent from the front section;

an adjustor, threadingly coupled to said first adjustment mechanism and said second adjustment mechanism, wherein said second adjustment mechanism acts as an anchor relative to said first adjustment mechanism, such that a force exerted by said adjustor changes a position of the first adjustment mechanism affixed to the front section relative to the second adjustment mechanism, and in turn adjusts a position of the front section relative to the inner wall along a vertical axis by increasing or decreasing a gap in the intermediate opening between the first adjustment mechanism and the second adjustment mechanism, wherein the second adjustment mechanism comprises a pair of mutually perpendicular walls, one of said walls positioned in a vertical plane and having a width sufficient to be received between the pair of lateral interior edges of the intermediate opening and maintain alignment relative to said vertical axis as the front section, together with a mechanical load comprising the panel or drawer, is adjustably positioned along the vertical axis.

8. A leveling system for panels or drawers within a cabinet comprising:

a rail;

a front section a first pair of lateral interior edges and a second pair of internal edges perpendicular to the lateral edges, the first and second pairs of interior edges defining an intermediate opening, which is centrally located relative to the front section, the front section further having at least one opening and at least a first adjustment mechanism affixed to the front section and movable in the intermediate opening;

wherein the rail and said front section form a singular structure, and wherein said front section supports an inner wall by way of at least one fastening means housed in said front section opening;

a second adjustment mechanism disposed in said intermediate opening, the second adjustment mechanism stationarily and directly affixed to said inner wall, wherein the second adjustment mechanism is mechanically independent from the front section;

an adjusting structure threadingly coupled to said first adjustment mechanism and said second adjustment mechanism, wherein the stationary second adjustment mechanism acts as an anchor relative to the first adjustment mechanism such that a force imparted by way of the adjusting structure causes movement of the first adjustment mechanism affixed to the front section with respect to the stationary second adjustment mechanism, the movement of the first adjustment mechanism effective to adjust a position of the front section along a vertical axis relative to the inner wall by increasing or decreasing a gap in the intermediate opening between the first adjustment mechanism and the second adjustment mechanism, wherein the second adjustment mechanism comprises a pair of mutually perpendicular walls, one of said walls positioned in a vertical plane and having a width sufficient to be received between the pair of lateral interior edges of the intermediate opening and maintain alignment relative to said vertical axis as the front section, together with a mechanical load comprising the panel or drawer, is adjustably positioned along the vertical axis.

* * * * *